US009982496B2

(12) United States Patent
Buytaert et al.

(10) Patent No.: US 9,982,496 B2
(45) Date of Patent: May 29, 2018

(54) ROLLED TUBULAR CENTRALIZER

(71) Applicant: Antelope Oil Tool & Mfg. Co., LLC, Mineral Wells, TX (US)

(72) Inventors: Jean Buytaert, Mineral Wells, TX (US); Clayton Plucheck, Tomball, TX (US); Jeffrey Kubiak, Houston, TX (US)

(73) Assignee: INNOVEX DOWNHOLE SOLUTIONS, INC., The Woodlands, TX (US)

( * ) Notice: Subject to any disclaimer, the term of this patent is extended or adjusted under 35 U.S.C. 154(b) by 797 days.

(21) Appl. No.: 13/957,016

(22) Filed: Aug. 1, 2013

(65) Prior Publication Data

US 2014/0096888 A1 Apr. 10, 2014

Related U.S. Application Data

(63) Continuation-in-part of application No. 13/191,074, filed on Jul. 26, 2011, now Pat. No. 8,851,168.

(51) Int. Cl.

| | |
|---|---|
| ***B23K 5/02*** | (2006.01) |
| ***E21B 19/24*** | (2006.01) |
| ***E21B 17/10*** | (2006.01) |

(52) U.S. Cl.

CPC ..... *E21B 19/24* (2013.01); *E21B 17/1028* (2013.01); *E21B 17/1078* (2013.01); *Y10T 29/49826* (2015.01); *Y10T 156/1038* (2015.01)

(58) Field of Classification Search

CPC .... B23K 9/0325; B23K 13/02; B23K 13/025; B23K 13/046

See application file for complete search history.

(56) References Cited

U.S. PATENT DOCUMENTS

| | | | |
|---|---|---|---|
| 2,009,496 | A | 7/1935 | Johnson |
| 3,312,285 | A | 4/1967 | Solum |

(Continued)

FOREIGN PATENT DOCUMENTS

| | | | |
|---|---|---|---|
| CA | 801991 | A | 12/1968 |
| JP | 54081156 | A * | 6/1979 |
| JP | 2011-115829 | | 6/2011 |

OTHER PUBLICATIONS

International Search Report dated Nov. 6, 2014 from International Application No. PCT/US2014/047837, pp. 1-18.

(Continued)

*Primary Examiner* — Erin B Saad

(74) *Attorney, Agent, or Firm* — MH2 Technology Law Group LLP

(57) ABSTRACT

A method of forming a centralizer where a flat plate is created into a tubular where the flat plate is typically rolled so that two sides of the plate contact one another and are then linked, typically by welding. Openings are then created in the tubular such that there are no corners or other points that stress cracks may originate. Once the openings are created the remaining material between adjacent openings forms ribs. The openings created in the tubular are generally aligned with the long axis of the tubular. The material at the upper and lower end of the flat plate where openings were not created serve as circumferential collars. The ribs may be radially outwardly expanded in order to provide adequate stand-off. In many instances the ribs will also be hardened by heat treating or other hardening processes.

29 Claims, 9 Drawing Sheets

(56) References Cited

U.S. PATENT DOCUMENTS

| | | | | |
|---|---|---|---|---|
| 4,088,186 | A | 5/1978 | Callihan et al. | |
| 5,566,754 | A | 10/1996 | Stokka | |
| 5,575,333 | A | 11/1996 | Lirette et al. | |
| 6,209,638 | B1 | 4/2001 | Mikolajczyk | |
| 6,533,034 | B1 | 3/2003 | Barger | |
| 6,637,511 | B2 | 10/2003 | Linaker | |
| 6,725,939 | B2 * | 4/2004 | Richard | E21B 43/103 166/241.6 |
| 6,997,254 | B2 | 2/2006 | Jenner | |
| 7,082,997 | B2 | 8/2006 | Slack | |
| 7,182,131 | B2 | 2/2007 | Gremillion | |
| 7,377,325 | B2 | 5/2008 | Trinder et al. | |
| 7,845,061 | B2 | 12/2010 | Buytaert et al. | |
| 7,849,918 | B2 | 12/2010 | Ehlinger et al. | |
| 7,878,241 | B2 | 2/2011 | Buytaert et al. | |
| 8,196,670 | B2 | 6/2012 | Jenner | |
| D662,952 | S | 7/2012 | Kirk et al. | |
| D671,960 | S | 12/2012 | Kirk et al. | |
| 8,555,964 | B2 | 10/2013 | MacLeod | |
| 2003/0000607 | A1 | 1/2003 | Jenner | |
| 2003/0089414 | A1 | 5/2003 | Ooyauchi et al. | |
| 2003/0230411 | A1 | 12/2003 | Richard | |
| 2008/0164019 | A1 | 7/2008 | Angman | |
| 2008/0283237 | A1 | 11/2008 | Buytaert et al. | |
| 2009/0025929 | A1 | 1/2009 | Buytaert et al. | |
| 2010/0288822 | A1 * | 11/2010 | Chung | B21C 37/122 228/145 |
| 2012/0138288 | A1 | 6/2012 | Buytaert et al. | |
| 2012/0186828 | A1 | 7/2012 | Lively et al. | |
| 2013/0248207 | A1 | 9/2013 | Kirk et al. | |

OTHER PUBLICATIONS

Final Office Action dated Apr. 30, 2015, U.S. Appl. No. 14/283,947, filed May 21, 2014, pp. 1-18.

Extended European Search Report dated Mar. 27, 2017, EP Application No. 14832286, filed Jul. 23, 2014, pp. 1-9.

* cited by examiner

ROLLED TUBULAR CENTRALIZER

FIELD OF INVENTION

Embodiments of the present invention generally relate to methods and apparatuses for a downhole operation. More particularly, the invention relates to methods and apparatuses for centralization in wellbores or tubulars.

BACKGROUND

In the course of drilling and producing oil and gas wells it has been found be beneficial to keep the tubular, which may be drill pipe, casing, production pipe, or screens generally centered in the well. In certain instances it may be desirable to center one tubular within another. By keeping the tubular generally centered in the well a substantially uniform annular area between the wellbore wall and the tubular is maintained. In certain instances, such as cementing the tubular into the well, centralization to provide a substantially uniform annular area is imperative. By having a substantially uniform annular area the cement is better able to fill all voids between the tubular and the well thereby forming a better bond with both the wellbore wall and the tubular.

A common type of centralizer is a bow spring centralizer. A bow spring centralizer typically includes a number of bows attached to a collar on the upper end of the bow and on the lower end of the bow. The bow typically curves radially outward between the two collars. In its simplest form the bow spring centralizer slides over a tubular joint and is restricted only by the tubular couplings at either end of the tubular joint. In some situations, when the bow spring centralizer is pushed into a wellbore on a tubular string the leading collar may be stopped by a restriction that will cause the bows to longitudinally compress thereby radially expanding the bows radially outwards ultimately causing the bow to fail as the tubular string continues to move down into the well. The problem is compounded due to the thickness of the bow spring centralizer's collars and ribs. Usually the collars and the ribs had the same thickness however the thickness of the centralizer as a whole centralizer was effectively doubled because the ribs were welded on top of the collar. In the event that a rib was welded edge to edge to the collar a generally weaker collar to rib interface is created and stress points are created by both the welding process and the remaining corners or other sharp points.

One solution has been to attach at least one of the collars of the bow spring centralizer so that the centralizer will be pulled into the wellbore rather than pushed into the wellbore.

SUMMARY

In order to minimize any potential stress points created by either welding or by having any sharp points or corners, it was envisioned that a centralizer is fabricated wherein a planar material having an upper end, a lower end, a first side, and a second side is formed into a tubular such that the planar material first side contacts the planar material second side. The planar material first side may be linked with the planar material second side. An elongated opening is then created in the tubular. The tubular has a long axis and the opening has a long axis having a first end and a second end such that the opening first end is adjacent the planar material upper end and the opening second end is adjacent the planar material lower end. Typically the opening does not have any corners and may be an oval, or a rectangle. Preferably the rectangle has rounded corners. In most instances the opening long axis is parallel to the long axis of the tubular although in some cases the opening long axis is not parallel to the long axis of the tubular. Typically the planar material first side is linked to the planar material second side by welding.

In another embodiment of fabricating a centralizer, a planar material having an upper end, a lower end, a first side, and a second side may be formed into a tubular such that the planar material first side contacts the planar material second side. The planar material first side is linked with the planar material second side. A number of elongated openings are then created in the tubular. The tubular has a long axis and each of the plurality of openings has a long axis having a first end and a second end such that the opening first end is adjacent the planar material upper end and the opening second end is adjacent the planar material lower end. While usually the planar material is rolled into a cylinder where the rolling is parallel to one side in some instances the planar material may be rolled into a cylinder by spiral winding process where the rolling is not parallel to either side. In such instances a long tubular may be formed without stopping. Typically the plurality of openings do not have corners. While usually the plurality of openings are ovals the openings may be rectangles although in most instances the rectangles have rounded corners. Typically the plurality of openings long axis are parallel to the long axis of the tubular although in some cases the plurality of openings long axis are not parallel to the long axis of the tubular. Usually the planar material first side is linked to the planar material second side by welding. In most instances the openings are created within the tubular structure that was formed from the planar material. The material in the tubular structure both above and below the openings define circumferential collars. The material in the tubular structure between the openings define ribs that are disposed between the upper collar and lower collar. Typically the ribs are expanded radially outward where the expansion process typically, but not always, plastically deforms the ribs. Typically the ribs and in many instances the entire centralizer may be heat-treated, hardened, cured, or any other process known to one skilled in the art to allow the ribs to elastically deflect after the ribs are expanded. However, in certain instances the ribs or the entire centralizer may be heat-treated, hardened, cured, or any other process known to one skilled in the art.

In another embodiment of fabricating a centralizer a first planar material having an upper end and a lower end, a first side, and a second side and at least a second planar material having an upper end, a lower end, a first side, and a second side may be formed into a tubular such that the first planar material first side contacts second planar material second side and the first planar material second side contacts the at least second planar material first side. The first planar material first side may be linked with the at least second planar material second side and the first planar material second side may be linked with the second planar material first side. A number of elongated openings are then created in the tubular. The tubular has a long axis and each of the plurality of openings has a long axis having a first end and a second end such that the opening first end is adjacent the planar material upper end and the opening second end is adjacent the planar material lower end. While usually the planar material is rolled into a cylinder where the rolling is parallel to one side in some instances the planar material may be rolled into a cylinder by spiral winding process where the rolling is not parallel to either side. In such instances a long tubular may be formed without stopping. Typically the plurality of openings do not have corners.

While usually the plurality of openings are ovals the openings may be rectangles although in most instances the rectangles have rounded corners. Typically the plurality of openings long axis are parallel to the long axis of the tubular although in some cases the plurality of openings long axis are not parallel to the long axis of the tubular. Usually the planar material first side is linked to the planar material second side by welding. In most instances the openings are created within the tubular structure that was formed from the planar material. The material in the tubular structure both above and below the openings define circumferential collars. The material in the tubular structure between the openings define ribs that are disposed between the upper collar and lower collar. Typically the ribs are expanded radially outward where the expansion process typically, but not always, plastically deforms the ribs. The ribs may be heat-treated, hardened, cured, or any other process known to one skilled in the art before or after the expansion or forming of the ribs.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The description that follows includes exemplary apparatus, methods, techniques, and instruction sequences that embody techniques of the inventive subject matter.

Figure 1:
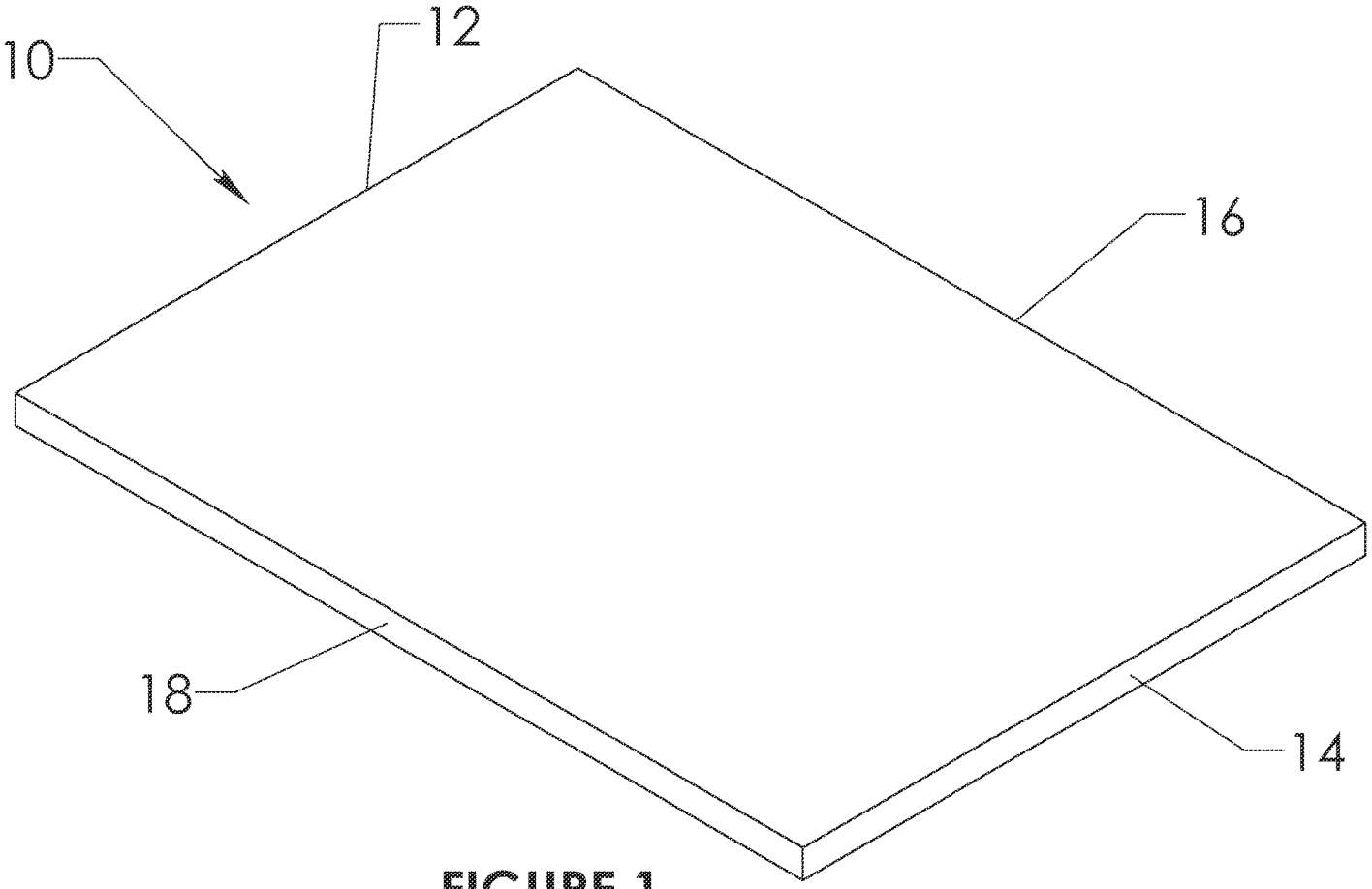
FIG. 1 depicts a generally flat material.

FIG. 1 depicts a generally flat material 10 having an upper end 12, a lower end 14, a first side 18 and a second side 16. Typically the process of forming a tubular begins with the generally flat material 10 where the generally flat material 10 does not have any openings or notches in the material. When forming the generally flat material 10 into the tubular, the generally flat material 10 may be rolled by a plate roll, may be hydraulically formed, hydro-dynamically formed, stamped, or any other process known for forming flat material into a roll. While it is anticipated that the generally flat material 10 will typically be a steel or other ferrous material, any material may be used including most metals, plastics, or fiber reinforced materials such as carbon fiber polymers and epoxies.

Figure 2:
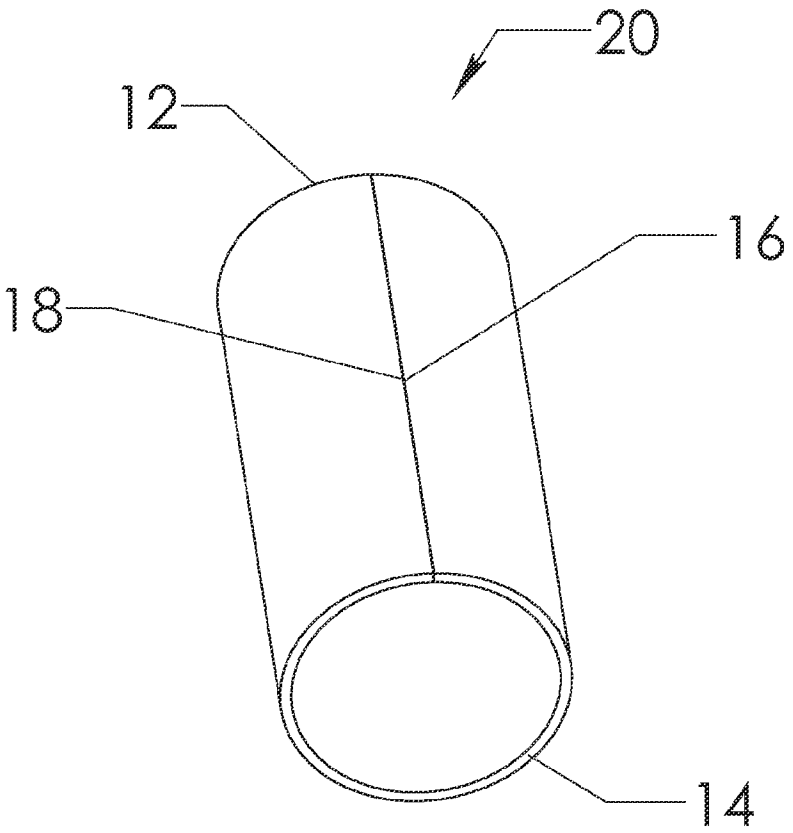
FIG. 2 depicts the generally flat material rolled into a tubular.

FIG. 2 depicts the generally flat material 10 from FIG. 1 after the generally flat material 10 has been rolled into a tubular 20 so that the first side 18 and the second side 16 are in contact with one another along their length. With the first side 18 in the second side 16 in contact with one another the sides 16 and 18 may be linked. In some instances the sides 16 and 18 may be linked one to the other by welding, crimping, pinning, gluing, epoxy or any other linking process known in the industry.

Figure 3:
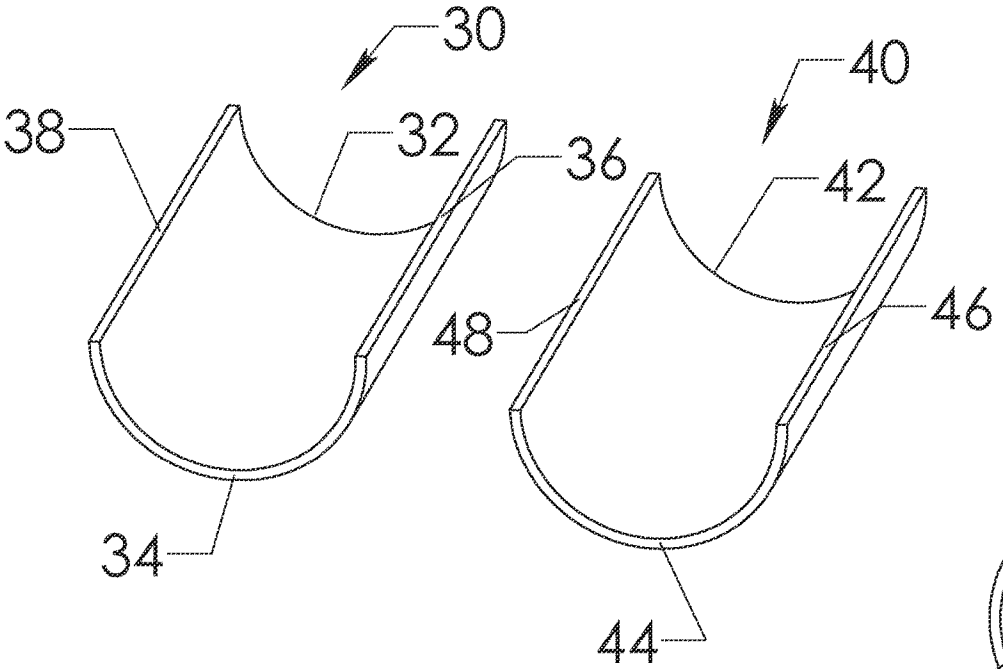
FIG. 3 depicts a first and a second generally flat material each formed into a portion of the tubular.

In some instances multiple generally flat materials may each be partially formed into a tubular such that when their sides come into contact with one another and are linked to multiple generally flat materials will form the tubular. FIG. 3 depicts a first curved piece of material 30 and a second curved piece of material 40 that were formed from two pieces of generally flat material. In this instance, the first curved piece of material 30 has an upper end 32, a lower end 34, a first side 36, and a second side 38. The second curved piece of material 40 has an upper end 42, a lower end 44, a first side 46, and the second side 48.

Figure 4:
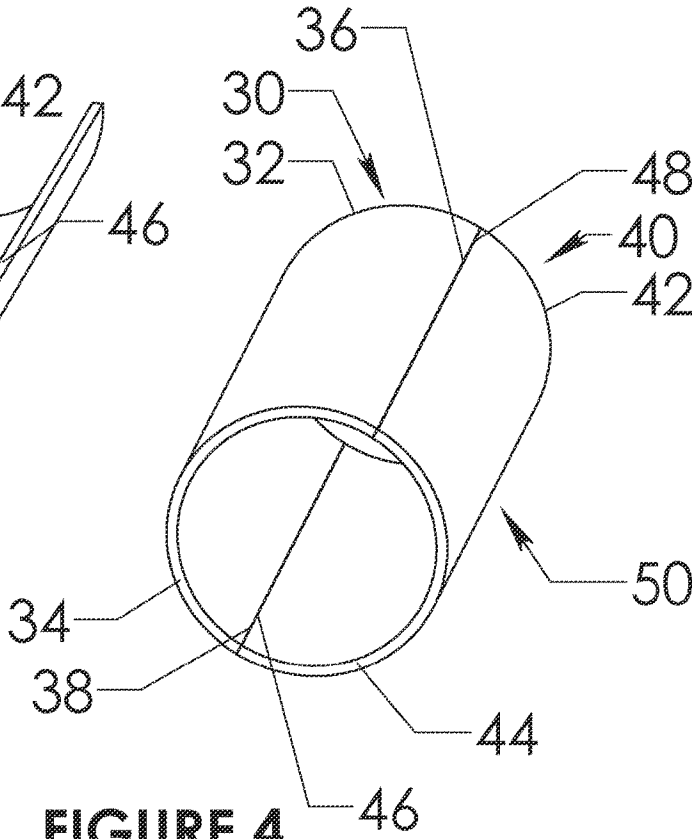
FIG. 4 depicts the first and the second generally flat piece of material each formed into a portion of the tube of FIG. 3 linked together.

FIG. 4 depicts the curved pieces of material 30 and 40 respectively that have been aligned such that the first side 36 of the first curved piece of material 30 and the second side 48 of the second curved piece of material 40 are in contact with one another along their length while the second side 38 of the first curved piece of material 30 and the first side 46 of the second curved piece of material 40 are also in contact with one another along their length. With the first curved piece of material 30 and the second curved piece of material 40 in contact with one another, the curved pieces of material may be linked together to form a tubular 50.

Figure 6:
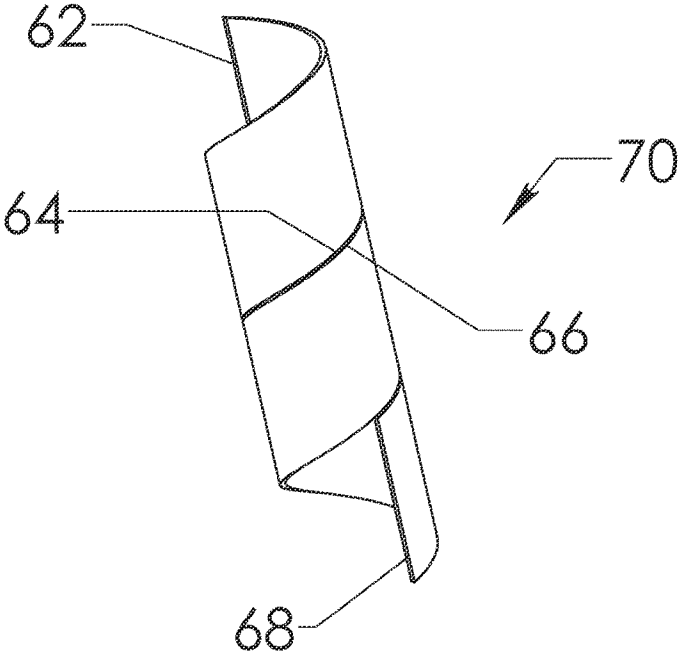
FIG. 6 depicts the generally flat piece of material of FIG. 5 formed into a tubular by spiral winding.
Figure 5:
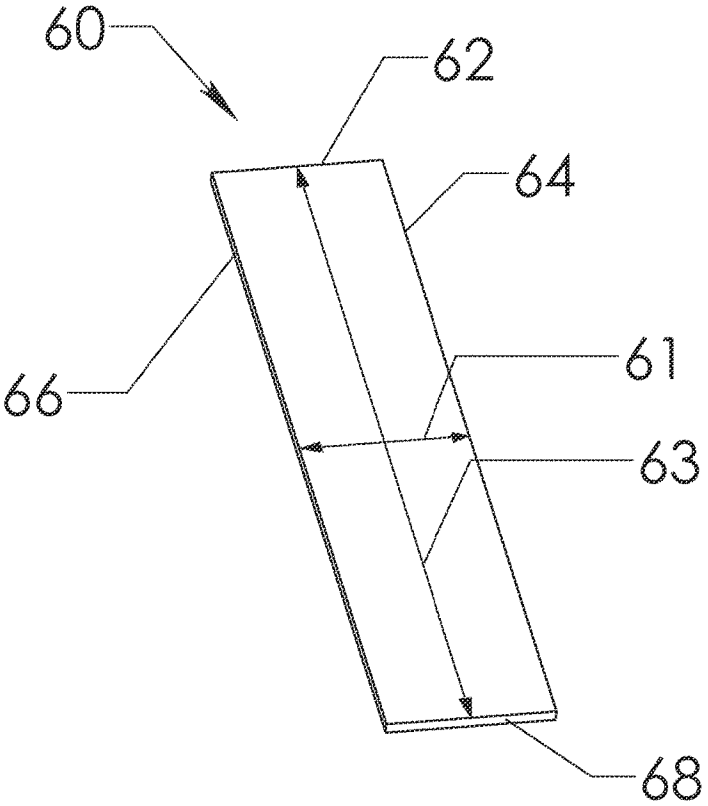
FIG. 5 depicts a generally flat piece of material having a length substantially greater than its width.

In other instances a generally flat material may be spiral wound such that its first side and the second side come into contact with one another. FIG. 5 depicts an elongated piece of generally flat material 60 where a length 63 is substantially greater than a width 61. The generally flat material 60 has an upper end 62, a lower end 68, a first side 64, and the second side 66. As depicted in FIG. 6, the generally flat material 60 has been formed into a tubular 70. The generally flat material 60 was rolled or otherwise formed into the tubular 70 at an angle that was not parallel to the upper end 62, the lower end 68, the first side 64, or the second side 66. The tubular 70 may be curved by a spiral winding process such that the first side 64 and the second side 66 may be linked to one another.

Figure 8:
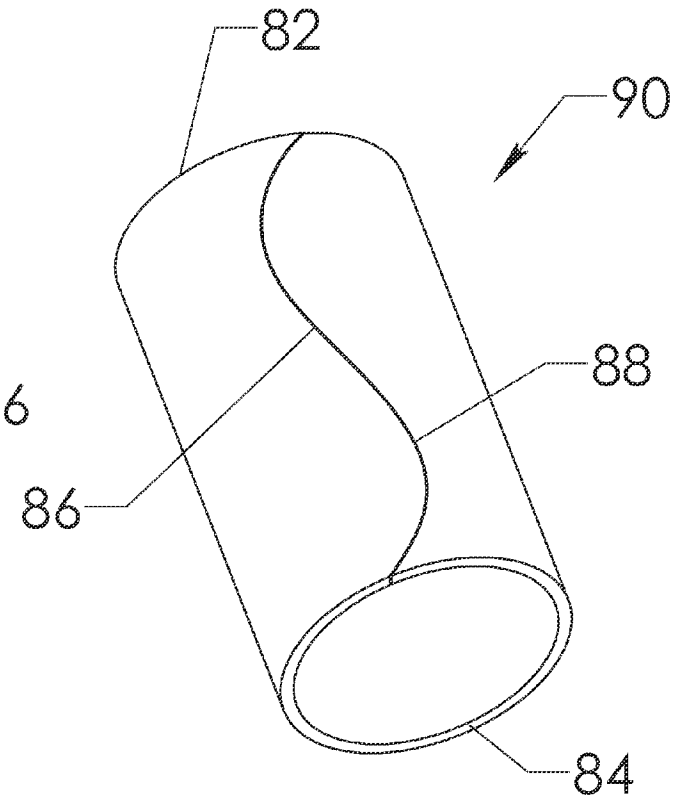
FIG. 8 depicts the generally flat piece of material of FIG. 7 rolled into a tubular so that the nonlinear first side and mirrored nonlinear second side mate together.
Figure 7:
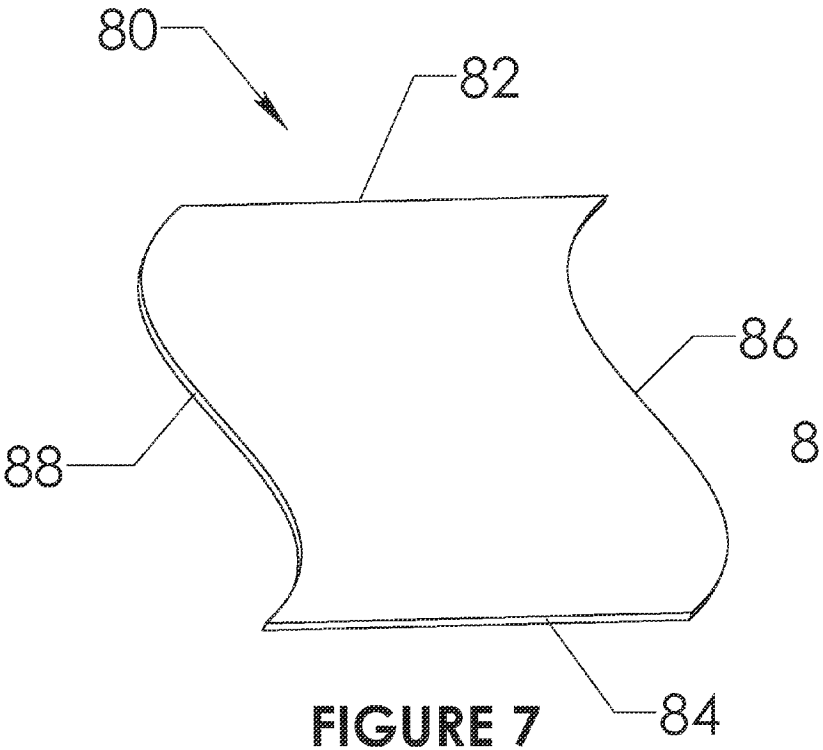
FIG. 7 depicts a generally flat piece of material having a nonlinear first side and a mirrored nonlinear second side.

In certain instances, as depicted in FIG. 7, a generally flat material 80 has an upper end 82, a lower end 84, a first side 88, and a second side 86 where the first side 88 and the second side 86 are nonlinear reflections of one another. FIG. 8 depicts the generally flat material 80 from FIG. 7 after the generally flat material 80 has been formed into a tubular 90 so that the first side 88 and the second side 86 are in contact with one another along their length. With the first side 88 in the second side 86 in contact with one another the two sides 86 and 88 may be linked to form a nonlinear seam between the sides 86 and 88. In those instances where the sides 86 and 88 are nonlinear reflections of one another the two sides may take any form such as a smooth curve, a jagged curve, zig-zags, or any other form.

Figure 9:
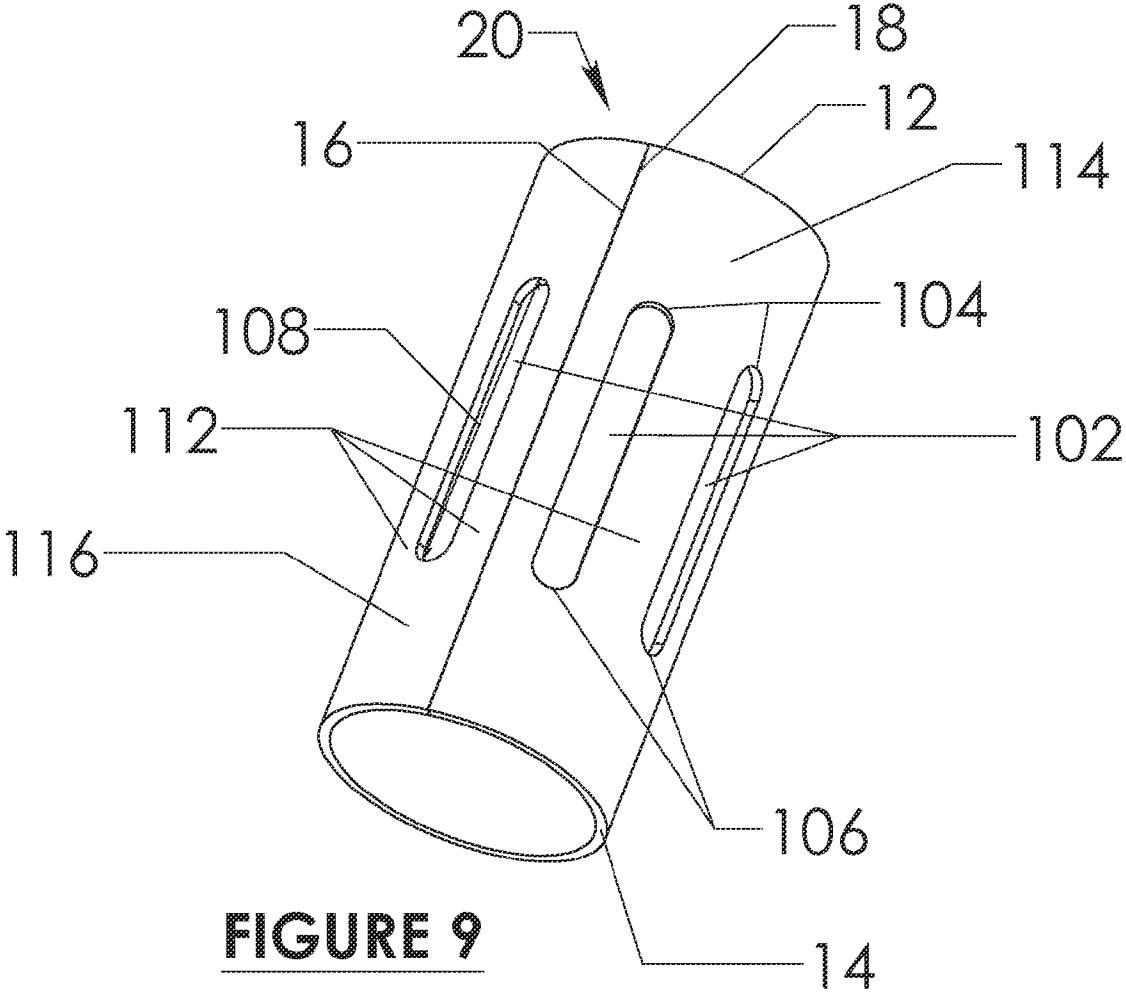
FIG. 9 depicts a rolled tubular with openings created therein that are parallel to the long axis of the tubular.

FIG. 9 depicts the tubular 20 of FIG. 2 where the first and the second sides 16 and 18 are linked together and with openings 102 created through the tubular 20. Generally the long axis of the tubular 20 is parallel to the seam created by linking first and second sides 16 and 18 although in some cases such as when the tubular is formed by spiral winding the seam will not be parallel to the long axis of the tubular. Each opening 102 has an upper end 104, a lower end 106, and a long axis 108 where the long axis 108 is generally parallel to the long axis of the tubular 20. Ribs 112 are created by the material of the tubular 20 that remains between the openings 102 after the openings 102 are created in the tubular 20. A first collar 114 and a second collar 116 are created by the material of the tubular 20 that remains above the upper end 104 of the openings 102 and below the lower end 106 of the openings 102 after the openings 102 are created in the tubular 20. To prevent failure in the ribs 112 as the ribs 112 are being moved downhole, the ribs 112 are created from the tubular 20 thereby eliminating the potential stress point such as when the ribs in the prior art are welded onto their collars. Additionally the openings 102 are created preferably as ovals to minimize stress points in the ribs 112 that may remain after the openings 102 are created in the tubular 20 although any shape that avoids sharp corners or points may be used. The openings 120 may be created in the tubular 50, 70, and 90 in a similar manner.

In certain instances such as when the material used to form the tubular is thick enough or is not hardened, heat treated, or cured to obtain spring-like properties, each rib 112 will have the ability to plastically deform when subjected to sufficient side load. In such cases, the centralizer will act like a rigid type centralizer that has the ability to give when inserted through a tight restriction. When the material is not as thick as in the case of a rigid centralizer described above and when the material is heat treated, hardened, or cured to provide spring-like properties, each rib 112 will have spring-like properties and the centralizer will act as a bow type centralizer.

Figure 10:
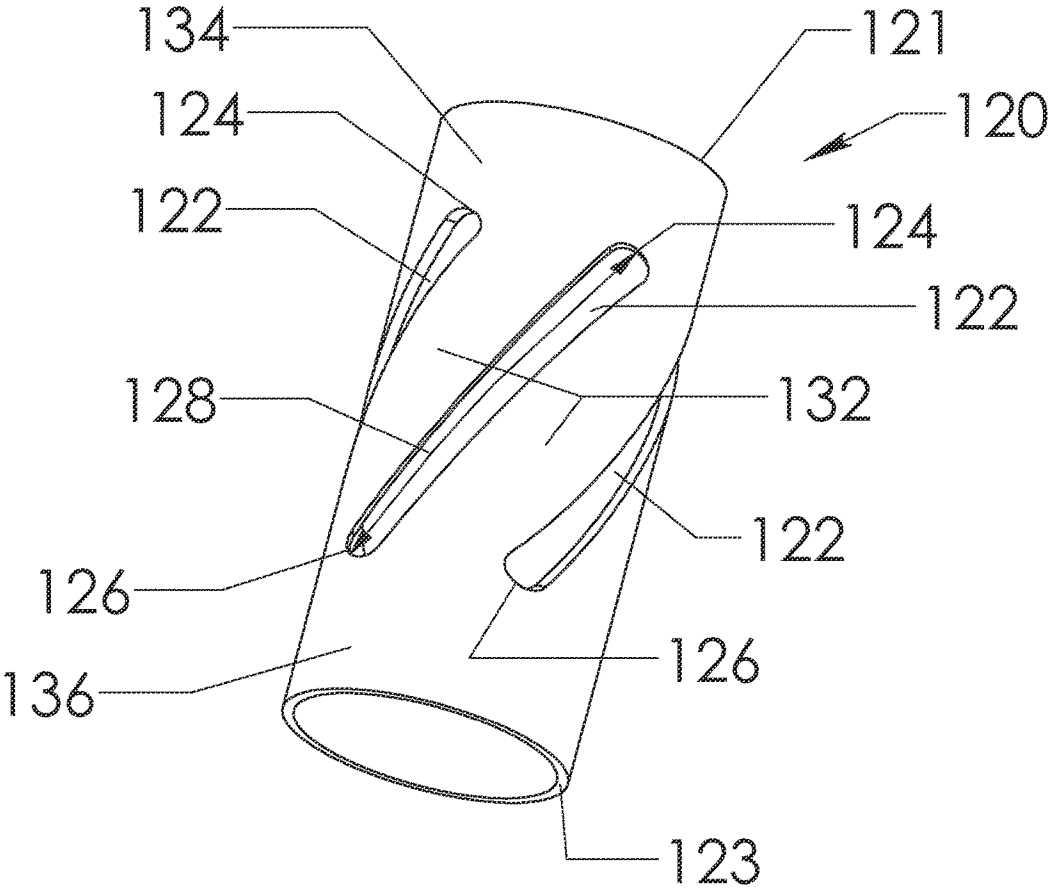
FIG. 10 depicts a rolled tubular with openings created therein that are not parallel to the long axis of the tubular.

FIG. 10 depicts a tubular 120 having an upper end 121, a lower end 123, and openings 122 created through the tubular 120. Each opening 122 has an upper end 124, a lower end 126, and a long axis 128 where the long axis 128 is generally not parallel to the long axis of the tubular 120. Ribs 132 are created by the material of the tubular 120 that remains between the openings 122 after the openings 122 are created in the tubular 120. A first collar 134 and the second collar 136 are created by the material of the tubular 120 that remains above the upper end 124 of the openings 122 and below the lower end 126 of the openings 122 after the openings 122 are created in the tubular 120. The openings 122 may be created in the tubular 20, 70, and 90 in a similar manner.

Figure 11:
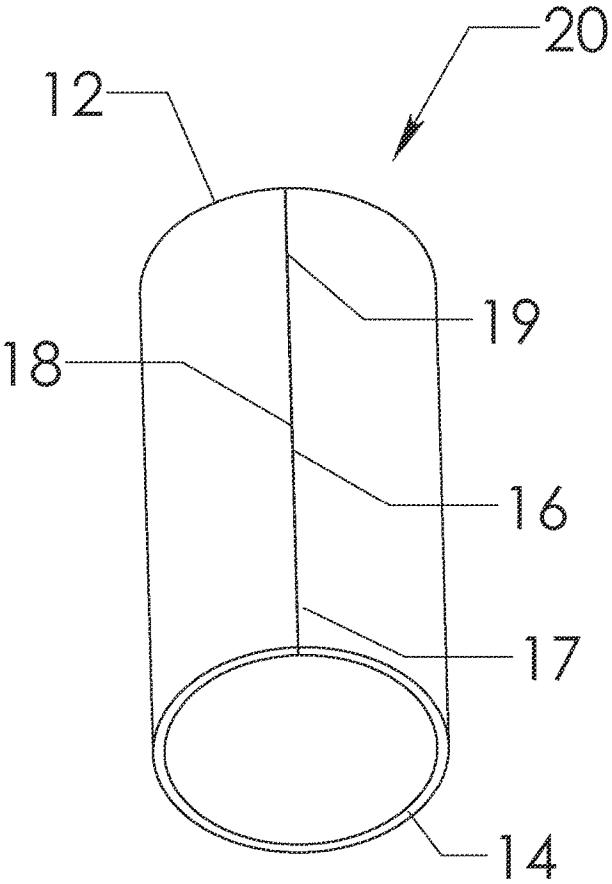
FIG. 11 depicts a rolled tubular where the first side and second side are partially linked.

FIG. 11 depicts the generally flat material 10 from FIG. 1 after the generally flat material 10 has been rolled into the tubular 20 so that the first side 18 and the second side 16 are in contact with one another along their length. With the first side 18 and the second side 16 in contact with one another a portion of the two sides 16 and 18 may be linked. For instance the two sides may be linked along the contact portion of the two sides 18 and 16 from the upper end 12 to any desired point such as point 19 (i.e. first portion) and from the lower end 14 to any desired point such as point 17 (i.e. second portion) leaving the contact portion of the two sides between point 19 and point 17 unlinked.

Figure 12:
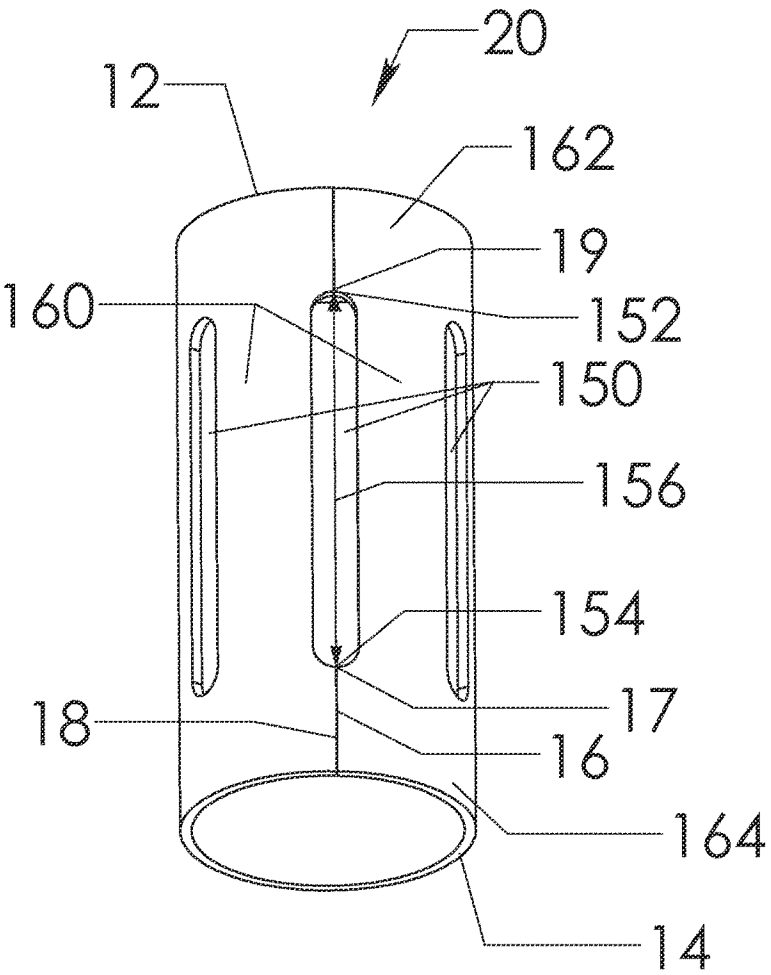
FIG. 12 depicts the rolled tubular of FIG. 11 where at least one opening is created across the unlinked portions between the first side and second side.

FIG. 12 depicts the tubular 20 from FIG. 11 having the upper end 12, the lower end 14, and at least one opening 150 created through the tubular 20.

When creating the opening 150 the material between the upper end 152 and the lower end 154 of the opening 150 where the first side 18 and second side 16 are adjacent, whether linked or not, is removed. The upper end 152 of the opening 150 may be located at point 19, between point 19 and the upper end 12 of the tubular 20, or between points 19 and 17. The lower end 154 of the opening 150 may be located at point 17, between point 17 and the lower end 14 of the tubular 20, or between points 17 and 19. Ribs 160 are created by the material of the tubular 20 that remains between the openings 150 after the openings 150 are created in the tubular 20. A first collar 162 and the second collar 164 are created by the material of the tubular 20 that remains above the upper end 152 of the openings 150 and below the lower end 154 of the openings 150 after the openings 150 are created in the tubular 20. While only the tubular with linear sides is depicted any created tubular may be used. The opening 150 may be created in the tubular 50 in a similar manner.

Figure 13:
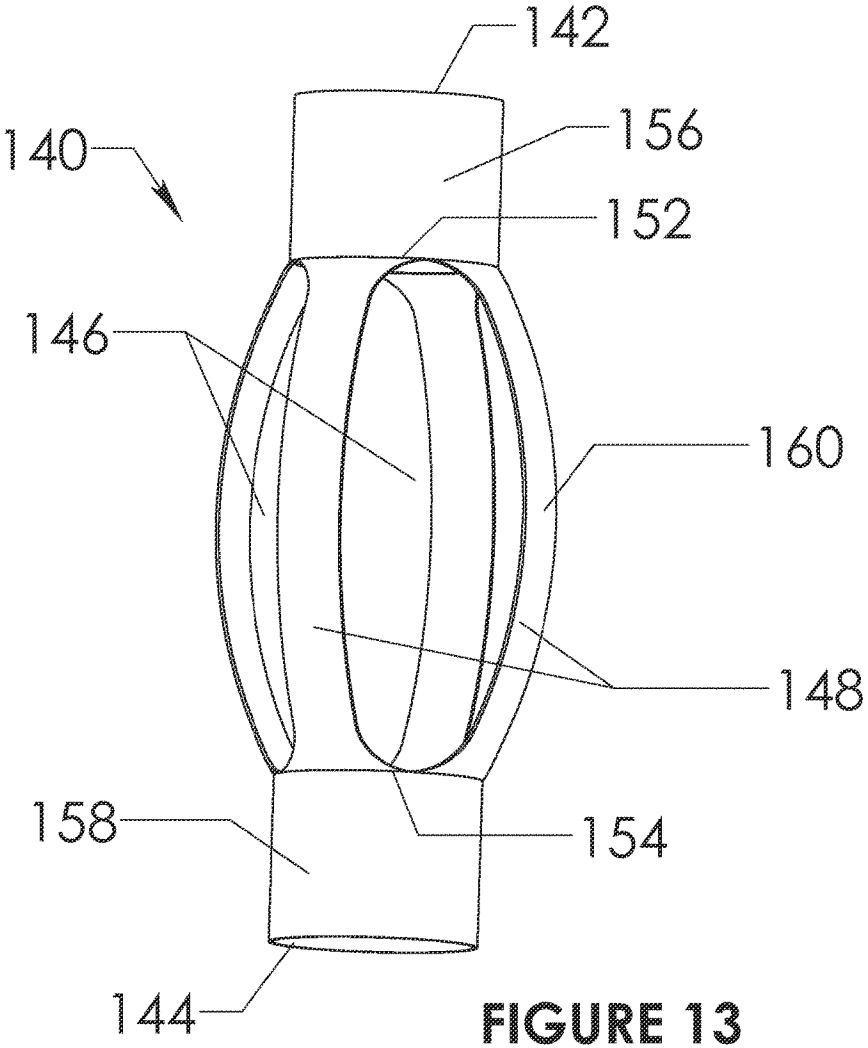
FIG. 13 depicts a rolled tubular having ribs that have been radially expanded.

FIG. 13 depicts a tubular 140 having an upper end 142, a lower end 144, openings 146, ribs 148, opening upper end 152, opening lower end 154, and upper collar 156, and a lower collar 158. The ribs 148 have been expanded radially outward so that each of the ribs 148 will have at least one portion, an apex 160 of each of the ribs 148 that extends further radially outward than other portions of each the ribs 148 or of the tubular 140. So that a portion of each of the ribs 148, typically the apex 160 of each rib 148, will contact the wellbore or other tubular wall (not shown). In many instances at least a portion of each of the ribs 148 will be treated to enhance the ability of each of the ribs 148 to elastically deform. Any treatment process such as heat treating, cold treating, curing, or any other process known in the industry may be used to enhance the ability each of the ribs 148 to elastically deform.

In practice it is generally understood that the tubular 140 (i.e. a centralizer) as depicted in FIG. 13 is placed on a separate tubular so that the collar 158, collar 156, and ribs 148 are generally coaxial with the separate tubular and that each collar 158 and 156 has a reasonably tight fit on the separate tubular. The centralizer may be allowed to slide up or down the separate tubular within the limits of couplings that are typically attached at either end of the separate tubular although more preferably at least one of the collars 158 or 156 are attached to the separate tubular. Collars 158 or 156 may be attached to the separate tubular by any attachment system known in the industry. For instance the collars 158 or 156 may be attached to the separate tubular as disclosed by U.S. patent application Ser. Nos. 11/749,544, 12/042,989, 12/756,173, 13/019,084, 13/476,807, and 12/913,495 which are each incorporated by reference herein. The tubular 20, 50, 70, or 90 may be placed on a separate tubular so that the collars and the ribs may be generally coaxial with the separate tubular. The tubular 20, 50, 70, or 90 may be a centralizer in a similar manner as described in relation to FIG. 13.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

While the foregoing is directed to embodiments of the present invention, other and further embodiments of the invention may be devised without departing from the basic scope thereof, and the scope thereof is determined by the claims that follow.

What is claimed is:

1. A method of fabricating a centralizer comprising:

forming a planar material into a tubular such that a first side of the planar material contacts a second side of the planar material;

linking the first side with the second side such that first and second seams are formed where the first and second sides are linked together, wherein an unlinked section is positioned between the first and second seams; and creating an elongated opening in the tubular by removing a portion of the tubular and at least a portion of the unlinked section, after the first and second seams are formed, thereby creating an elongated rib in the tubular that has a shape that is arcuate in an axial cross-section in a circumferential direction, wherein the elongated opening has a long axis having a first end and a second end such that the first end is adjacent an upper end of the tubular and the second end is adjacent a lower end of the tubular.

2. The method of claim 1, wherein the elongated opening comprises a plurality of elongated openings.

3. The method of claim 1, wherein creating the elongated opening in the tubular further comprises creating at least one elongated opening in the tubular adjacent to the first side and to the second side.

4. The method of claim 2, wherein forming the planar material into the tubular further comprises spiral winding the planar material.

5. The method of claim 2, wherein the plurality of openings have rounded corners.

6. The method of claim 2, wherein the plurality of openings are ovals.

7. The method of claim 2, wherein the plurality of openings are rectangles.

8. The method of claim 7, wherein the rectangles have rounded corners.

9. The method of claim 2, wherein the long axis of the opening is parallel to a long axis of the tubular and a long axis of the seam.

10. The method of claim 2, wherein the long axis of the opening is at an angle relative to a long axis of the tubular.

11. The method of claim 2, wherein the first side is linked to the second side by welding.

12. The method of claim 2, wherein the upper end of the tubular defines a circumferential upper collar, the lower end of the tubular defines a circumferential lower collar, and the rib is disposed between the upper collar and lower collar.

13. The method of claim 12, further comprising:

expanding the rib radially outward.

14. The method of claim 12, further comprising:

expanding the rib by plastically deforming the ribs radially outward.

15. The method of claim 12, further comprising:

heat treating the rib.

16. The method of claim 12, further comprising:

hardening the rib.

17. The method of claim 12, further comprising:

curing the rib.

18. The method of claim 1, wherein the first side and the second side are linked at a first section and a second section.

19. The method of claim 18, wherein the elongated opening is formed between the first section and the second section.

20. A method of fabricating a centralizer comprising:

forming a first planar material and a second planar material into a tubular such that a first side of the first planar material contacts a second side of the second planar material and a second side of the first planar material contacts a first side second planar material;

linking the first side of the first planar material with the second side of the second planar material and the second side of the first planar material with the first side of the second planar material, wherein linking the first side of the first planar material with the second side of the planar material comprises:

forming a first seam connecting together the first side of the first planar material and the second side of the second planar material and extending from an axial end of the tubular to a first point; and forming a second seam connecting together the first side of the first planar material and the second side of the second planar material and extending from an opposite axial end of the tubular to a second point that is spaced axially apart from the first point, wherein an unlinked portion of the first side of the first planar material and the second side of the second planar material extends from the first point to the second point; and creating a plurality of elongated openings in the tubular, thereby creating an elongated rib in the tubular between each pair of adjacent elongated openings, wherein at least one of the plurality of elongated openings is formed at least in part by removing the unlinked section after forming the first and second seams, each elongated rib having a shape that is arcuate in an axial cross-section, in the circumferential direction, wherein the plurality of elongated openings each have a long axis having a first end and a second end such that the first end is adjacent an upper end of the tubular and the second end is adjacent a lower end of the tubular.

21. The method of claim 20, wherein the plurality of openings have rounded corners.

22. The method of claim 20, wherein the plurality of openings are ovals.

23. The method of claim 20, wherein the plurality of openings are rectangles.

24. The method of claim 23, wherein the rectangles have rounded corners.

25. The method of claim 20, wherein the long axis of the plurality of openings is parallel to a long axis of the tubular.

26. The method of claim 20, wherein the long axis of the plurality of openings is at an angle relative to a long axis of the tubular.

27. The method of claim 20, wherein the first side of the first planar material is linked to the second side of the second planar material by welding.

28. The method of claim 20, wherein the upper end of the tubular defines a circumferential upper collar, the lower end of the tubular defines a circumferential lower collar, and the rib is disposed between the upper collar and lower collar.

29. The method of claim 1, wherein the shape of the elongated rib in the tubular is arcuate in an axial cross-section, in the circumferential direction, proximate to the first end and the second end of the long axis of the elongated opening and arcuate as proceeding in the axial direction along the long axis.

* * * * *